US011591812B2

(12) United States Patent
Zemler et al.

(10) Patent No.: US 11,591,812 B2
(45) Date of Patent: Feb. 28, 2023

(54) SYSTEMS AND METHODS FOR AN INDICATOR SYSTEM IN FIRESTOP PROTECTION SYSTEMS

(71) Applicant: HILTI AKTIENGESELLSCHAFT, Schaan (LI)

(72) Inventors: Matthew Zemler, Corinth, TX (US); Lucas Ackerman, McKinney, TX (US); Matthew Samuels, Highland Village, TX (US)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/953,119

(22) Filed: Nov. 19, 2020

(65) Prior Publication Data

US 2021/0180343 A1 Jun. 17, 2021

Related U.S. Application Data

(60) Provisional application No. 62/947,614, filed on Dec. 13, 2019.

(51) Int. Cl.
*E04G 15/06* (2006.01)
*A62C 2/06* (2006.01)

(52) U.S. Cl.
CPC ..... *E04G 15/061* (2013.01); *A62C 2/065* (2013.01)

(58) Field of Classification Search
CPC .. E04G 15/061; F16L 5/02; F16L 5/04; F16L 1/06; E04B 5/48; E04B 1/948; E04B 1/947; H02G 3/22; H02G 3/0412; A62C 2/065
See application file for complete search history.

(56) References Cited

U.S. PATENT DOCUMENTS

| | | | | |
|---|---|---|---|---|
| 4,018,416 | A * | 4/1977 | Diener | B28B 7/342 249/62 |
| 4,432,465 | A * | 2/1984 | Wuertz | E04B 1/947 138/89 |
| 4,619,087 | A * | 10/1986 | Harbeke | E04G 15/061 285/64 |
| RE32,678 | E * | 5/1988 | Benscoter | H02G 3/22 174/482 |
| 9,086,174 | B2 | 7/2015 | McConnell et al. | |
| 9,103,116 | B2 | 8/2015 | McConnell et al. | |
| 9,388,570 | B2 | 7/2016 | Brown et al. | |
| 9,476,199 | B2 | 10/2016 | McConnell et al. | |
| 10,344,472 | B2 | 7/2019 | McConnell et al. | |
| 2004/0100040 | A1* | 5/2004 | Sakno | F16L 5/04 277/635 |
| 2004/0168398 | A1* | 9/2004 | Sakno | F16L 5/04 52/741.4 |
| 2006/0063418 | A1* | 3/2006 | Motzigkeit | H02G 15/013 439/425 |
| 2012/0124928 | A1* | 5/2012 | Tubbs | E04B 1/947 52/317 |

* cited by examiner

*Primary Examiner* — Gisele D Ford
(74) *Attorney, Agent, or Firm* — Leydig, Voit & Mayer, Ltd.

(57) ABSTRACT

A system includes a lead-sleeve coupled to a platform. The platform attaches to a sheet metal having alternating peaks and valleys, and the platform includes a block-out component that conforms to a valley of the sheet metal. The system also includes an indicator system coupled to a cap of the lead-sleeve, where the indicator system protrudes through the concrete after the concrete is poured and solidified around the lead-sleeve.

7 Claims, 4 Drawing Sheets

SYSTEMS AND METHODS FOR AN INDICATOR SYSTEM IN FIRESTOP PROTECTION SYSTEMS

CROSS-REFERENCE TO RELATED APPLICATIONS

This patent application claims the benefit of U.S. Provisional Patent Application No. 62/947,614, filed Dec. 13, 2019, which is incorporated by reference.

BACKGROUND OF THE INVENTION

The present disclosure relates generally to the field of firestop protection, and more particularly to systems and methods for indicator systems within a firestop protection system.

In contemporary building constructions, formworks formed of corrugated sheet metal having alternating valley and peak regions are widely used. Formworks may be used in substantially horizontal ceilings, in floors, or in walls. In certain situations, formworks utilized in horizontal ceiling applications may be cast in concrete on-site, such that the corrugated sheet metal remains on the lower side of the ceiling. Furthermore, in certain construction applications, tubular leads, conduits, cables, or various other items are routed through the formwork and the concrete. Various techniques may be utilized to form through-penetrations through the corrugated sheet metal so that these and other materials may be routed through the ceiling. For example, in certain situations, through-penetrations may be formed with pre-installation systems that are fixed to the formwork before the concrete is poured. After the concrete has been formed and solidified, the through-penetrations may be formed by drilling holes (e.g., coring) through the corrugated sheet metal in the concrete-free region underneath the pre-installation system.

However, in certain situations, it may be difficult for an operator to locate and identify the drilling site, at least in part because the pre-installation system may be partially or entirely concealed by the poured concrete. Accordingly, it may be beneficial to provide systems and methods for locating and/or identifying the drilling site (e.g., the pre-installation system) after the concrete has been poured and solidified on the formwork.

BRIEF SUMMARY OF THE INVENTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In a first embodiment, a system includes a lead-sleeve coupled to a platform. The platform attaches to a sheet metal having alternating peaks and valleys, and the platform includes a block-out component that conforms to a valley of the sheet metal. The system also includes an indicator system coupled to a cap of the lead-sleeve, where the indicator system protrudes through the concrete after the concrete is poured and solidified around the lead-sleeve.

BRIEF DESCRIPTION OF THE SEVERAL VIEWS OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION OF THE INVENTION

Figure 1:
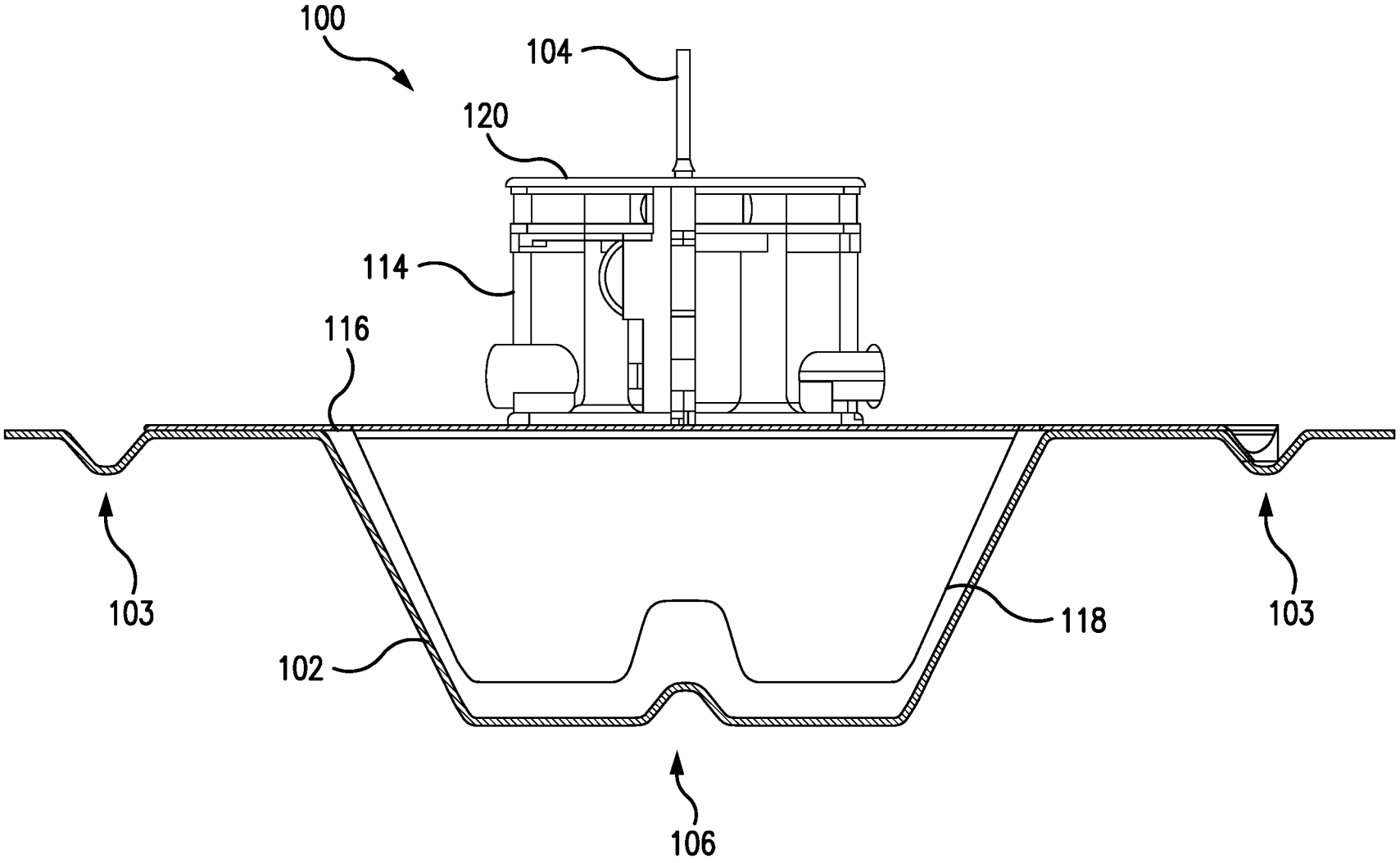
FIG. 1 is a schematic view of an embodiment of a pre-installation system for forming through-penetrations through a corrugated sheet metal formwork, where the pre-installation system includes an indicator system, in accordance with aspects of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

The present embodiments are directed to systems and methods for a pre-installation system having an indicator system utilized for locating and/or identifying the location of the pre-installation system after concrete is poured and solidified. In certain embodiments, pre-installation systems may be utilized to form through-penetrations at any position of a corrugated sheet metal formwork. In certain embodiments, the pre-installation system may include a platform, a block-out component, and a lead-sleeve configured to couple to the platform, as further described in detail below. In particular, the pre-installation system may include an indicator system that is utilized as a marker or identifier to located and/or identify the location of the pre-installation system after concrete is poured and solidified. For example, after concrete is poured and solidified, the indicator system may be utilized by an operator to easily locate the position of the pre-installation system which may otherwise be partially or wholly hidden from sight underneath the concrete.

In certain embodiments, the pre-installation system (e.g., the platform, the block-out component, and the lead-in sleeve) may be positioned on the corrugated sheet metal at a desired location before concrete is poured. In particular, the block-out material may create a concrete-free region underneath the pre-installation system after the concrete is poured and solidified. In this manner, a cutting tool may be able to easily cut through the corrugated sheet metal through the concrete-free region to create the through-penetration. For example, in certain embodiments, after the concrete is poured around the pre-installation system, a protective guiding sleeve is inserted into the lead-in sleeve of the pre-installation system. Further, the cutting tool is inserted through the protective guiding sleeve to cut through the corrugated sheet metal to create a through-penetration through which a tubular conduit (e.g., tubular leads, conduits, cables, etc.) may be inserted.

However, in certain embodiments, it may be difficult to locate and/or identify the position of the pre-installation system on the corrugated sheet metal, at least in part because the pre-installation system may be partially or entirely hidden from view by concrete or other materials. For example, after the concrete is poured and has solidified, it may be difficult for an operator to identify the exact location of the pre-installation system so that the cutting tool may be utilized to cut through the corrugated sheet metal to form the through-penetration. Temporary solutions, such as a hand-marked flag or other job-site material, may be unreliable at least in part because they might be dislodged or moved when concrete is poured. Accordingly, the present embodiments are generally related to an indicator system that is coupled to a cap of the pre-installation system. In particular, the indicator system may be configured to protrude through the top surface of the poured and solidified concrete, such that the location of the pre-installation system is easily visible from above the surface of the concrete. These and other features of the pre-installation system are described in further detail with respect to FIGS. 1-8.

Turning now to the drawings, FIG. 1 is a schematic view of an embodiment of a pre-installation system 100 for forming through-penetrations through a corrugated sheet metal formwork 102. In particular, the pre-installation system 100 includes an indicator system 104, in accordance with aspects of the present disclosure.

The pre-installation system 100 may be disposed at various locations on the corrugated sheet metal 102. In certain embodiments, the pre-installation system 100 may include a lead-sleeve 114, a platform 116, and a block-out component 118. The lead-sleeve 114 may be configured to provide a concrete-free space through the corrugated sheet metal 102, and may be utilized with or without the platform 116 and the block-out component 118. In certain embodiments, the platform 116 may be configured to provide support for the lead-sleeve 114 across various locations of the corrugated sheet metal 102. In particular, the platform 116 may be utilized to bridge the gap between the alternating valleys (e.g., a valley 106) and peaks (e.g., a peak 103) of the corrugated sheet metal 102. Specifically, the platform 116 may be configured to support the lead-sleeve 114 along the corrugated sheet metal 102, thereby allowing the lead-sleeve 114 to be positioned anywhere along the alternating peaks and valleys of the corrugated sheet metal 102. For example, the lead-sleeve 114 may be positioned above the valley 106 at approximately the same height as the peak 103. As a further example, the platform 116 may support the lead-sleeve 114 such that it is positioned between two consecutive peaks 103. In certain embodiments, attachment means may be utilized to secure the platform 116 to the corrugated sheet metal 102, such as, for example, screws, pins, adhesives, rivets, welding, direct fastening, hooks, etc. Furthermore, the platform 116 may secure the pre-installation system 100 against vibrations and other forces during subsequent drilling within the concrete. The platform 116 may be formed of a rigid material, such as metal, wood, plastic, fiber-reinforced material, etc.

In certain embodiments, the lead-sleeve 114 may be a fire-retarding system, that includes an intumescent material. For example, the lead-sleeve 114 may include a ring-shaped sealing configured to surround a tubular conduit received through the passage of the lead-sleeve 114, and the ring-shaped sealing may be formed at least in part by the intumescent material. Accordingly, in higher temperatures, the intumescent material expands into a mass to shield the radial perimeter from the heat-generated pressure and closes the opening through which the tubular conduit extends.

In certain embodiments, the block-out component 118 may be configured to provide a concrete-free space through which a tubular conduit may be later inserted, as further described below. The block-out component 118 may be an elastically compliant membrane (e.g., gasket) that is configured to form a concrete-tight seal across various configurations of the deck profile—such as, but not limited to, lap-joint seams or other proprietary/unique embossed profiles representative of competitive manufactures of the corrugated sheet metal 102. In certain embodiments, the block-out component 118 may be coupled to the platform 116. Specifically, the block-out component 118 may be formed of any material or construction that prevents the spread of concrete when it is poured into a region of the corrugated sheet metal 102. In the illustrated embodiment, the block-out component 118 may be formed of two parallel components 163 shaped to correspond to the dimensions and shape of the valley 106 (e.g., walls and floor). Accordingly, the space below the platform 116 and the lead-sleeve 114, between the two parallel components 163, and within space of the valley 106 may be concrete-free, thereby easily allowing a post cutout of the corrugated sheet metal 102. In certain embodiments, the block-out components 118 may be a solid shape corresponding to the dimensions and shape of the valley 106. In certain embodiments, the block-out component 118 may be formed of any material (e.g., foam, mineral wool, elastic material, flexible material, fiber material, air bladder, cellulose pulp, etc.) that is flexible enough to tightly abut against the floor of the valley 106 of the corrugated sheet metal 102, but may be structured enough to resist the spread or leaking of poured concrete 180.

Accordingly, the pre-installation system 100 may be positioned on the corrugated sheet metal 102 before concrete is poured around system 100. In particular, the pre-installation system 100 may prevent the spread of the concrete into certain regions of the corrugated sheet metal 102, thereby helping subsequent cutting of materials through the lead-sleeve 114 to create the through-penetration. For example, after the poured concrete turns into solidified concrete, a cap 120 covering a passage through the lead-sleeve 114 may be removed. In certain embodiments, a protective guiding sleeve may be inserted through the passage to protect the lead-sleeve 114 from the cutting process. In certain embodiments, the protective guiding sleeve may be formed of a metal, plastic, foil, waxed cardboard, or any flexible, smooth, and/or non-adhesive surface that facilitates the passage of the cutting tool through the lead-sleeve 114. In certain embodiments, a cutting tool may be inserted through the passage to cut through the block-out material 118 and/or the corrugated sheet metal 102. The cutting tool may be any cutting tool that may be inserted through the passage 188 of the lead-sleeve 114 to cut out one or more portions of the corrugated sheet metal 102. In certain embodiments, a tubular conduit insert may be inserted into the pre-installation system 100 through the through-penetration formed by the cutting tool.

In some situations, after concrete is poured around the system 100, it may be difficult for an operator to identify and/or location the position of the pre-installation system 100 underneath the concrete. Accordingly, the pre-installation system 100 includes the indicator system 104 coupled to an upper surface of the cap 120. In particular, the indicator system 104 may be configured to protrude from the upper surface of the cap 120 such that it marks the location of the pre-installation system 100 underneath the concrete, as further described with respect to FIGS. 2-4.

Figure 2:
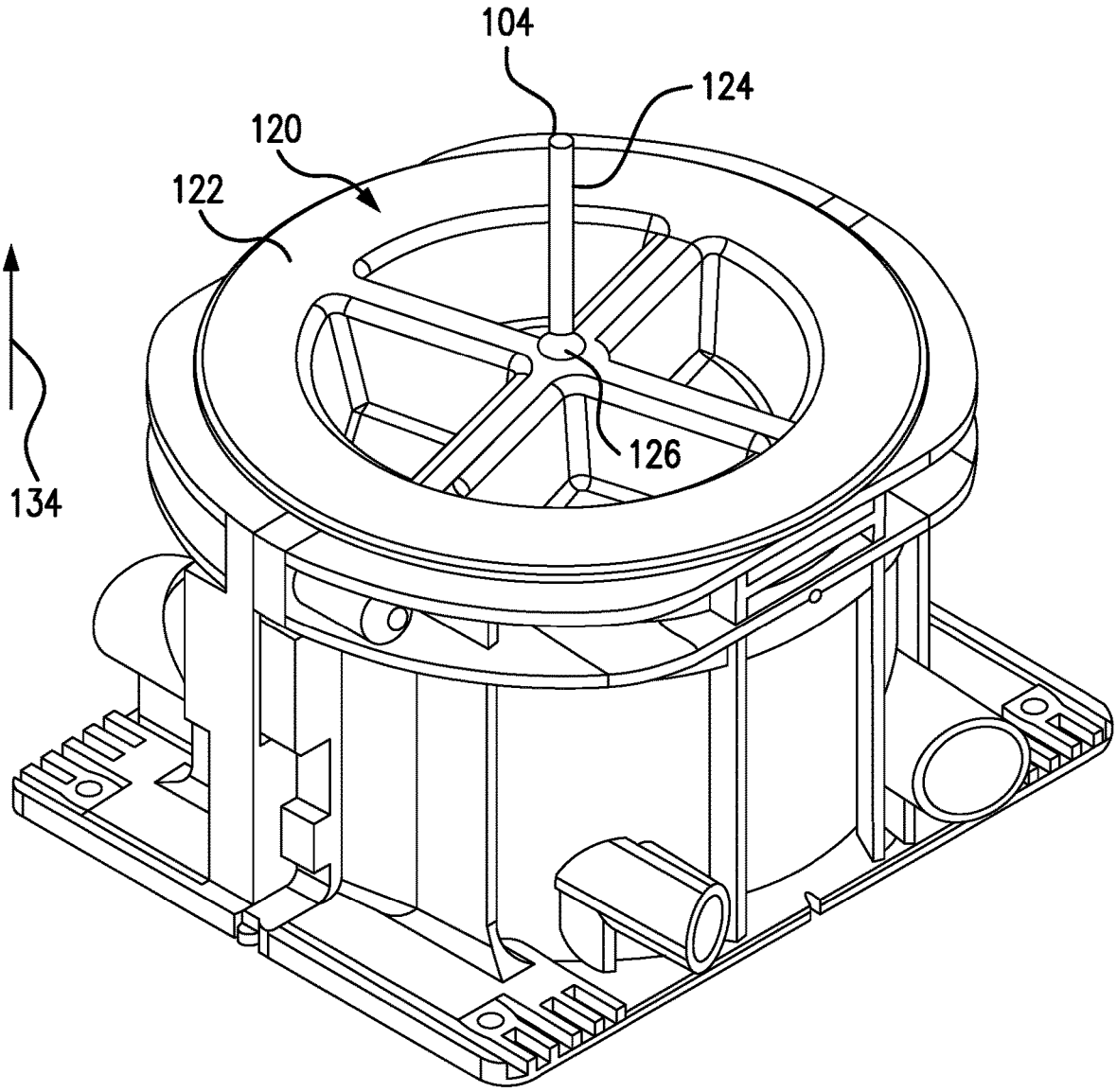
FIG. 2 is a perspective view of an embodiment of the pre-installation system of FIG. 1, in accordance with aspects of the present disclosure.

FIG. 2 is a perspective view of an embodiment of the pre-installation system 100 of FIG. 1, in accordance with aspects of the present disclosure. In the illustrated embodiment, the indicator system 104 is coupled through the upper surface 122 of the cap 120, as further described in detail below.

In certain embodiments, the indicator system 104 may be permanently coupled to the upper surface 122 without any fastening features (e.g., screws, nails, etc.), latches, clamps, connectors and/or removably engaging features. Specifically, the indicator system 104 may include a rod profile 124, a first base 126, a second base 128 (illustrated in FIG. 3), and an intermediary portion 130 (illustrated in FIG. 3). As illustrated, the rod profile 124 may be configured to protrude vertically away from the upper surface 122 of the cap 120, such that it appears above a surface of concrete (as described in FIG. 4). In certain embodiments, the indicator system 104 may be formed of a resilient elastomeric material that would allow for repeated movement without cyclic fatigue failure. For example, the material may be a synthetic rubber material (e.g., ethylene propylene diene monomer rubber), a nylon material, a plastic material, or any other type of flexible material.

In certain embodiments, the thickness of the rod profile 124 and the material of the rod profile 124 are directly correlated to the overall flexibility and functionality of the rod profile 124. For example, if the rod profile 124 is formed of a harder rubber material, the thickness of the rod profile 124 would be decreased to maintain the same overall flexibility of the indicator system 104. In certain embodiments, the thickness of the rod profile 124 is approximately 2 mm, 3 mm, 4 mm or 5 mm. In particular, the overall thickness of the rod profile 124 remains flexible enough to be bent during manufacturing, packaging and shipping, but not too flexible that it deforms when concrete is poured around the system 100. In certain embodiments, the rod profile 124 may include one or more rods that protrude from the first base 126. In certain embodiments, the height of the indicator system 104 may be greater than 30 mm, 35 mm, 40 mm, or 45 mm, such that the rod profile 124 protrudes from the surface of the concrete, as described with respect to FIG. 4. In certain embodiments, the height of the rod profile 124 may be determined and/or selected based on the height of the poured concrete. In the illustrated embodiment, the hole is positioned at the center of the cap 120. In other embodiments, the hole may be positioned anywhere on the cap 120—such as along the perimeter of the cap 120.

Figure 3:
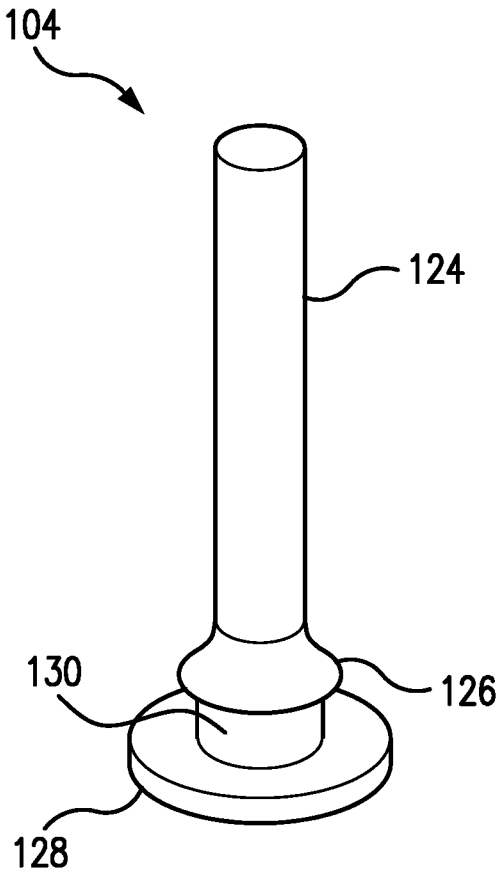
FIG. 3 is a perspective view of an embodiment of the indicator system of FIG. 1, in accordance with aspects of the present disclosure.

FIG. 3 is a perspective view of an embodiment of the indicator system 104 of FIG. 1, in accordance with aspects of the present disclosure. In certain embodiments, the indicator system 104 includes the rod profile 124, a first base 126, a second base 128, and an intermediary portion 130.

In certain embodiments, the indicator system 104 may be pre-assembled with the cap 120 during the manufacturing process of the pre-installation system 100. In certain embodiments, the indicator system 104 may be assembled on-site, such as by an operator installing the system 100 on the job site. For example, the indicator system 100 may be easily assembled by pushing the rod profile 124 through a hole 131 of the cap 120. In particular, the size of the hole 131 through the cap 120 may be large enough to accommodate the thickness of the rod profile 124 and the first base 126, but not large enough to accommodate the thickness or width of the second base 128. In certain embodiments, the thickness or width of the intermediary portion 130 may be approximately the same as the diameter of the hole 131 through the cap 120. Accordingly, during assembly of the indicator system, the rod profile 124 of the indicator system 104 may be pushed through the cap such that the rod and the first base 124 pass through the cap 120 in a first direction 134 (illustrated in FIG. 2). Further, the intermediary portion 130 may fit snug within the cap 120, and the second base 128 does not pass through the hole 131 and remains underneath the cap 120 on the lower surface 136 (illustrated in FIG. 4). In certain embodiments, the second base 128 may form a compression seal against the underside of the cap 120, such that no materials are able to pass through the hole 131 after the installation process of the indicator system 104. In certain embodiments, the curvature of the first base 126 assists during the installation process of the indicator system 104 into the cap 120. Specifically, the curvature of the first base 126 allows the first base 126 to be pushed in the first direction 134 through the hole 131 in the cap 120.

Accordingly, the indicator system 104 may be easily assembled on-site by an operator who may choose a particular type of indicator based on the identification system desired. For example, an operator may choose a particular color of indicator systems 100 corresponding to a particular conduit that is passed through the pre-installation system 100 after the installation process. As a further example, an operator may choose a particular size (e.g., length of the rod profile 124) based on the amount of concrete poured and the height of the solidified concrete. Indeed, the indicator system 104 may include other forms of identification, such as text, grooves, color-coded patterns, shapes or any other type of visual indicia. Further, an operator may choose indicator systems 104 based on the desired location and/or identification method.

In certain embodiments, the indicator system 104 may be pre-assembled with the cap 120 during the manufacturing process of the pre-installation system 100. In particular, the flexibility of the indicator system 104 may allow one or more caps 120 to be stacked together during packaging and transport. It should be noted that the indicator system 100 may bend in any direction, and may be resilient enough to revert back to an upright position after packaging and transportation.

During the manufacturing process, the indicator system 104 may be formed as a single-piece in an injection molding process. In certain embodiments, the indicator system 104 may be formed via compression molding and/or transfer molding. Furthermore, in certain embodiments, the indicator system 104 may be formed as a single piece with the cap 120. In such embodiments, the rod profile 124 may include a living hinge at the first base 126 and the intermediary portion 130, such that the indicator system 104 retains its flexibility and resiliency.

Figure 4:
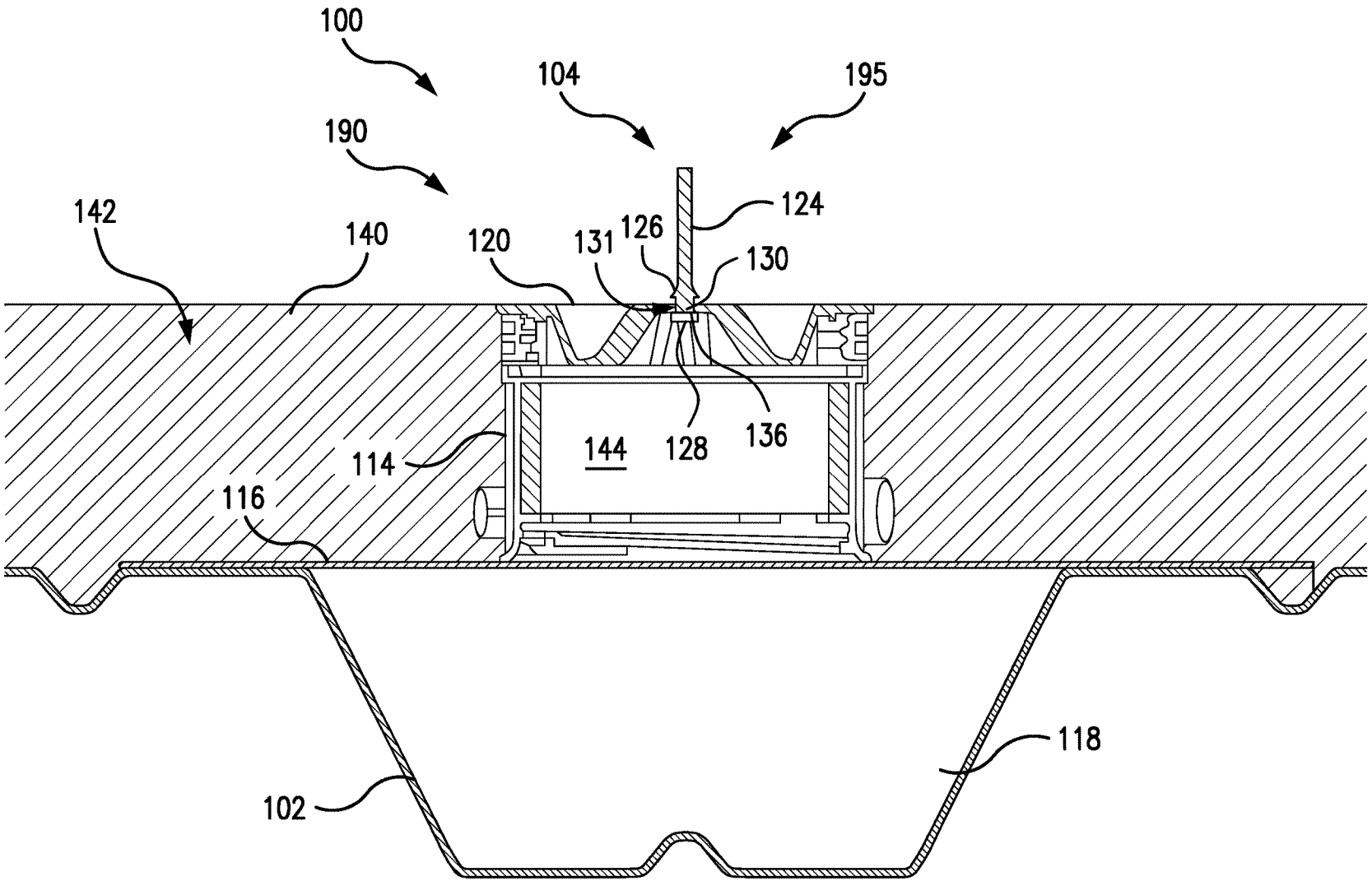
FIG. 4 is a schematic view of an embodiment of the pre-installation system of FIG. 1, where the indicator system protrudes from a top surface of poured concrete.

FIG. 4 is a cross-sectional view of an embodiment of the pre-installation system 100 of FIG. 1, where the indicator system 104 protrudes from a top surface 140 of poured concrete 142. After the poured concrete 142 turns into solidified concrete, the cap 120 covering a passage 144 through the lead-sleeve 114 may be removed. Further, as noted above, a protective guiding sleeve may be inserted through the passage to protect the lead-sleeve 114 from the cutting process, and a cutting tool 190 may be inserted through the passage to cut through the block-out material 118 and/or the corrugated sheet metal 102.

In some situations, after the concrete 142 is poured around the system 100, it may be difficult for an operator to identify and/or location the position of the pre-installation system 100 underneath the concrete. However, the indicator system 104 coupled to the cap 120 allows an operator to identify and locate the pre-installation system 100 underneath the solidified concrete 142. Accordingly, an operator may utilize the indicator system 100 to locate and remove the cap 120, to drill a hole through the block-out material 118 and/or the corrugated sheet metal 102, and to insert a tubular conduit 195 into the pre-installation system 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a lead-sleeve coupled to a platform, wherein the platform is configured to be attached to a sheet metal comprising alternating peaks and valleys, and wherein the platform comprises a block-out component configured to conform to a valley of the sheet metal; and an indicator system coupled to a cap of the lead-sleeve, wherein the indicator system protrudes through a top surface of concrete after the concrete is poured and solidified around the lead-sleeve, allowing an operator to locate and/or identify the indicator system above the top surface of the solidified concrete.

2. The system of claim 1, wherein the indicator system comprises a rod profile approximately perpendicular to an upper surface of the cap.

3. The system of claim 2, wherein the indicator system comprises a first base, a second base, and intermediary section disposed between the first base and the second base.

4. The system of claim 3, wherein the first base is disposed above the upper surface of the cap.

5. The system of claim 3, wherein the second base is disposed below the upper surface of the cap.

6. The system of claim 3, wherein the intermediary section is disposed through the cap.

7. The system of claim 1, wherein the indicator system comprises visual indicia, and wherein the visual indicia comprises a color, a text, a number, a letter, a pattern, a groove, or any combination thereof.

* * * * *